US009571922B2

(12) United States Patent
Kwon

(10) Patent No.: US 9,571,922 B2
(45) Date of Patent: Feb. 14, 2017

(54) APPARATUS AND METHOD FOR CONTROLLING BEAMFORMING MICROPHONE CONSIDERING LOCATION OF DRIVER SEAT

(71) Applicant: HYUNDAI MOBIS CO., LTD., Seoul (KR)

(72) Inventor: Min Ho Kwon, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 169 days.

(21) Appl. No.: 14/483,963

(22) Filed: Sep. 11, 2014

(65) Prior Publication Data

US 2015/0117669 A1 Apr. 30, 2015

(30) Foreign Application Priority Data

Oct. 25, 2013 (KR) ..... 10-2013-0128119

(51) Int. Cl.
*H04R 1/32* (2006.01)
*H04R 3/00* (2006.01)

(52) U.S. Cl.
CPC ..... *H04R 1/326* (2013.01); *H04R 3/005* (2013.01); *H04R 2499/13* (2013.01)

(58) Field of Classification Search
CPC ..... H04R 1/326; H04R 3/005; H04R 2499/13
See application file for complete search history.

(56) References Cited

U.S. PATENT DOCUMENTS

| | | | | |
|---|---|---|---|---|
| 7,039,197 | B1 * | 5/2006 | Venkatesh | H04R 3/005 381/86 |
| 2002/0102002 | A1 * | 8/2002 | Gersabeck | B60R 16/0373 381/86 |
| 2006/0145537 | A1 * | 7/2006 | Escott | B60R 11/02 307/10.1 |
| 2008/0071547 | A1 * | 3/2008 | Prieto | G10L 15/19 704/275 |
| 2010/0208914 | A1 | 8/2010 | Ohtsuka | |

FOREIGN PATENT DOCUMENTS

| | | | |
|---|---|---|---|
| JP | 2007-302155 | A | 11/2007 |
| KR | 1999-0024488 | A | 4/1999 |
| WO | 2007/025265 | A2 | 3/2007 |

OTHER PUBLICATIONS

European Search Report dated Mar. 11, 2015 of corresponding European Patent Application No. 14 183 1503-6 pages.

* cited by examiner

*Primary Examiner* — Ping Lee
(74) *Attorney, Agent, or Firm* — Knobbe Martens Olson & Bear LLP

(57) ABSTRACT

An apparatus for controlling a beamforming microphone considering the location of a driver seat may include: a driver seat sensor configured to sense the location of the driver seat and output the sensed location as a driver seat signal; a directivity control unit configured to calculate a beamforming angle based on the driver seat signal; and a signal processing unit configured to process voice signals outputted from first and second microphones, respectively, and extract and output a voice signal generated from a direction which coincides with the beamforming angle.

9 Claims, 2 Drawing Sheets

| LOCATION OF DRIVER SEAT | -30cm | -20cm | -10cm | 0cm | 10cm | 20cm | 30cm |
|---|---|---|---|---|---|---|---|
| BEAMFORMING ANGLE | 30 degrees | -20 degrees | -10 degrees | 0 degrees | 10 degrees | 20 degrees | 30 degrees |

APPARATUS AND METHOD FOR CONTROLLING BEAMFORMING MICROPHONE CONSIDERING LOCATION OF DRIVER SEAT

CROSS-REFERENCES TO RELATED APPLICATIONS

The present application claims priority to Korean application number 10-2013-0128119, filed on Oct. 25, 2013, which is incorporated by reference in its entirety.

BACKGROUND

The present disclosure relates to an apparatus and method for controlling a beamforming microphone considering the location of a driver seat, and more particularly, to an apparatus and method for controlling a beamforming microphone considering the location of a driver seat, which controls a beamforming microphone used in a hands free system for a vehicle such that the directivity of the beamforming microphone traces the location of the driver seat.

A hands free system for a vehicle collects the voice of a driver through a microphone installed in the vehicle and transmits the collected voice to a phone line such that the driver can talk on the phone even while driving the vehicle.

Inside the vehicle, however, unnecessary sounds, such as engine sound or audio sound, as well as the voice of the driver may be transmitted to the hands free system. Thus, a beamforming microphone capable of minimizing the influence of surrounding noise or interfering sound using multiple microphones may be used as the microphone which is employed in the hands free system and installed inside the vehicle. Such a beamforming microphone may be applied to a hands free system or voice recognition system for a vehicle. In the interior space of a vehicle, two microphones are typically used to collect voice.

The related art is disclosed in Korean Patent Laid-open Publication No. 1996-0024488 published on Apr. 6, 1999 and entitled "Hands free device of vehicle phone".

SUMMARY

Embodiments of the present invention are directed to an apparatus and method for controlling a beamforming microphone considering the location of a driver seat, which controls a beamforming microphone used in a hands free system for a vehicle such that the directivity of the beamforming microphone traces the location of the driver seat and the beamforming microphone reliably captures a driver's voice, thereby improving a phone quality.

In one embodiment, an apparatus for controlling a beamforming microphone considering the location of a driver seat may include: a driver seat sensor configured to sense the location of the driver seat and output the sensed location as a driver seat signal; a directivity control unit configured to calculate a beamforming angle based on the driver seat signal; and a signal processing unit configured to process voice signals outputted from first and second microphones, respectively, and extract and output a voice signal generated from a direction which coincides with the beamforming angle.

The beamforming angle may include an angle which faces the location of the driver seat, indicated by the driver seat signal, from the central point between locations at which the first and second microphones are installed.

The apparatus may further include an electronic control unit configured to control overall operations of a hands free system, and transmit the driver seat signal received from the driver seat sensor to the directivity control unit.

The directivity control unit may calculate a beamforming angle corresponding to the location of the driver seat, indicated by the driver seat signal, using a previously stored table which associates the location of the driver seat with the beamforming angle.

The signal processing unit may extract a voice signal generated from a direction corresponding to the range of a beamforming region around the beamforming angle, and the range of the beamforming region may be set on the basis of vehicle speed and the intensity of noise contained in each of the voice signals.

In another embodiment, a method for controlling a beamforming microphone considering the location of a driver seat may include: sensing, by a driver seat sensor, the location of the driver seat and outputting the sensed location as a driver seat signal; calculating, by a directivity control unit, a beamforming angle based on the driver seat signal; and processing, by a signal processing unit, voice signals outputted from first and second microphones, respectively, and extracting and outputting a voice signal generated from a direction which coincides with the beamforming angle.

In the calculating of the beamforming angle, the beamforming angle may be calculated as an angle which faces the location of the driver seat, indicated by the driver seat signal, from the central point between locations at which the first and second microphones are installed.

The driver seat signal outputted from the driver seat sensor may be inputted to an electronic control unit which controls overall operations of a hands free system, and the electronic control unit may transmit the driver seat signal to the directivity control unit.

In the calculating of the beamforming angle, the beamforming angle may be calculated through a previously stored table which associates the location of the driver seat with the beamforming angle.

In the extracting and outputting of the voice signal, the signal processing unit may extract a voice signal generated from a direction corresponding to the range of a beamforming region around the beamforming angle, and the range of the beamforming region may be set on the basis of vehicle speed and the intensity of noise contained in each of the voice signals.

In accordance with the embodiments of the present invention, the apparatus and method for controlling a beamforming microphone considering the location of a driver seat may control the directivity of the beamforming microphone according to the location of the driver seat such that the beamforming microphone reliably captures the voice of the driver, thereby improving the phone quality of the hands free system for the vehicle.

DESCRIPTION OF SPECIFIC EMBODIMENTS

An apparatus and method for controlling a beamforming microphone considering the location of a driver seat in accordance with an embodiment of the invention will hereinafter be described in detail with reference to the accompanying drawings.

It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

A beamforming microphone extracts only a sound source signal inputted in a specific direction, using time delay which occurs between sound source signals collected through the two microphones. That is, the beamforming microphone processes the signals inputted from the respective microphones so as to extract only the source signal inputted at a preset directivity angle. In this case, the extent of a directivity angle at which the source signal is extracted around the direction set to extract the source signal, that is, a beamforming region may be set to perform signal processing.

In a hands free system, when the beamforming region is excessively narrow, the vocalization position of a user may be limited. When the beamforming region and the directivity angle are fixed, noise may not be properly removed or the voice of the user may be not properly extracted in case where the position of the user is changed or the inflow direction of the noise is changed to increase noise in a certain direction.

Figures 1, 2:
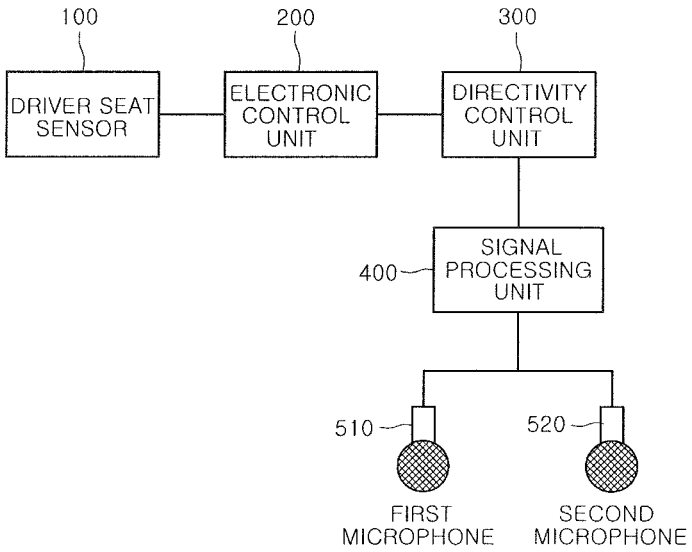
FIG. 1 is a configuration diagram of an apparatus for controlling a beamforming microphone considering the location of a driver seat in accordance with an embodiment of the present invention.
FIG. 2 is an example of a table which associates a location of a driver seat with a beamforming angle in accordance with the embodiment of the present invention.

FIG. 1 is a configuration diagram of an apparatus for controlling a beamforming microphone considering the location of a driver seat in accordance with an embodiment of the present invention.

As illustrated in FIG. 1, the apparatus for controlling a beamforming microphone considering the location of a driver seat in accordance with the embodiment of the present invention may include a driver seat sensor 100, a directivity control unit 300, and a signal processing unit 400.

The driver sensor 100 may sense the location of a driver seat and output the sensed location as a driver seat signal.

In general, the driver seat of a vehicle may be moved back and forth by about 30 cm according to a driver's control. The driver seat sensor 100 may sense the location of the driver seat and output the sensed location as a driver seat signal.

At this time, the driver seat signal may be outputted to an electronic control unit 200 through a CAN (Controller Area Network) communication network. Depending on embodiments, the driver seat signal may not be passed through the electronic control unit 200, but directly outputted to the directivity control unit 300.

When the driver seat signal is outputted through the CAN communication network, the electronic control unit 200 may control overall operations of the hands free system, and transmit the driver seat signal inputted from the driver seat sensor 100 to the directivity control unit 300.

The electronic control unit 200 of the vehicle may control the respective units of the vehicle including an engine, based on signals inputted from the respective units of the vehicle through the CAN communication network. Thus, the electronic control unit 200 may receive a driver's manipulation signal for the hands free system through the CAN communication network, and receive a driver seat signal from the driver seat sensor 100 through the CAN communication network. Furthermore, the electronic control unit 200 may transmit the driver seat signal to the directivity control unit 300 through the CAN network.

As the driver seat signal is transmitted through the electronic control unit 200 using the CAN communication network, a separate communication path for signal transmission does not need to be provided.

The directivity control unit 300 may calculate a beamforming angle based on the driver seat signal indicating the location of the driver seat.

As described above, the beamforming microphone may extract only a sound source signal inputted in a specific direction, using time delay which occurs between sound source signals collected through two microphones.

At this time, the beamforming angle may indicate the direction of the sound source signal extracted through the beamforming microphone.

The beamforming angle may be set to such an angle that faces the location of the driver seat, indicated by the driver seat signal, from the central point between the locations at which first and second microphones 510 and 520 constituting the beamforming microphone are installed.

As the beamforming angle is set, the beamforming microphone including the first and second microphones 510 and 520 may extract and output a voice signal of which the sound source is set to the location of the driver seat.

Furthermore, the directivity control unit 300 may calculate a beamforming angle corresponding to the location of the driver seat, indicated by the driver seat signal, using a previously stored table which associates a location of the driver seat with a beamforming angle.

For example, as illustrated in FIG. 2, the initial location of the driver seat may be set to a location corresponding to 0 cm, and the driver seat may be moved back and forth by 10 cm up to 30 cm. At this time, the beamforming angles at which the first and second microphones installed in the vehicle are directed to the respective locations of the driver seat may be stored in the table.

In the example of FIG. 2, when the location of the driver seat corresponds to 10 cm, the beamforming angle may be calculated as 10 degrees, when the location of the driver seat corresponds to 30 cm, the beamforming angle may be calculated as 30 degrees, and when the location of the driver seat corresponds to −30 cm, that is, 30 cm to the rear, the beamforming angle may be calculated as −30 degrees, that is, 30 degrees to the rear.

The signal processing unit 400 may process voice signals outputted from the first and second microphones 510 and 520, and output a voice signal generated from the direction which coincides with the beamforming angle.

At this time, the signal processing unit 400 may output a voice signal generated from the direction which coincides with the set beamforming angle, using a phase difference between the voice signal of the first microphone 510 and the voice signal of the second microphone 520.

Furthermore, the signal processing unit 400 may extract a voice signal generated from the direction corresponding to the range of the beamforming region around the beamforming angle. In this case, the range of the beamforming region may be set on the basis of vehicle speed and the intensity of noise contained in each of the voice signals.

As described above, the beamforming microphone may extract only a voice signal generated at the set beamforming angle, and the signal processing unit 400 may process the voice signals inputted from the respective microphones. In this case, the signal processing unit 400 may set the range in which source signals are to be extracted around the direction set to extract the source signals, that is, a beamforming region, in order to perform signal processing.

At this time, when the speed of the vehicle is high or the intensity of noise collected from the first or second microphone is high, the noise generated inside the vehicle may have a high intensity. Thus, only a voice signal generated from a narrower beamforming region may be extracted to increase the possibility that the driver's voice will be accurately captured.

Thus, when the speed of the vehicle or the intensity of noise is high, the signal processing unit 400 may set a narrow range of beamforming region.

Figure 3:
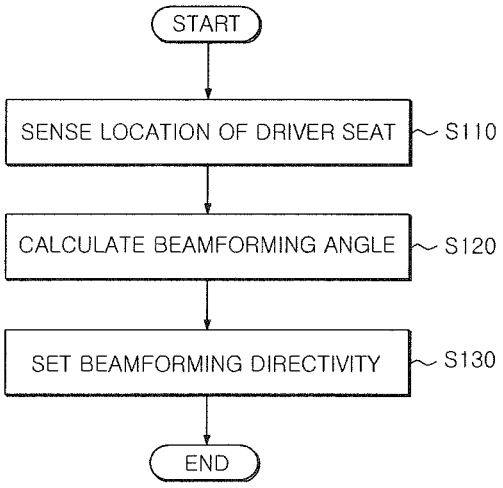
FIG. 3 is a flowchart illustrating a method for controlling a beamforming microphone considering the location of a driver seat in accordance with an embodiment of the present invention.

FIG. 3 is a flowchart illustrating a method for controlling a beamforming microphone considering the location of a driver seat in accordance with the embodiment of the present invention. Referring to FIG. 3, the method for controlling a beamforming microphone considering the location of a driver seat in accordance with the embodiment of the present invention will be described.

First, the driver seat sensor may sense the location of the driver seat and output the sensed location as a driver seat signal at step S110.

As described above, the driver seat of a vehicle may be moved back and forth according to control of a driver, and the driver seat sensor 100 may sense the location of the driver seat and output the sensed location as a driver seat signal.

At this time, the driver seat signal may be outputted to the electronic control unit 200 through a CAN communication network. Depending on embodiments, the driver seat signal may not be passed through the electronic control unit 200, but directly outputted to the directivity control unit 300.

When the driver seat signal is outputted through the CAN communication network, the electronic control unit 200 may control the overall operation of the hands free system, and transmit the driver seat signal inputted from the driver seat sensor 100 to the directivity control unit 300.

Then, the directivity control unit 300 may calculate a beamforming angle based on the driver seat signal, at step S120.

The beamforming angle may be set to such an angle that faces the location of the driver seat, indicated by the driver seat signal, from the central point between the locations at which the first and second microphones 510 and 520 constituting the beamforming microphone are installed.

As described with reference to FIG. 2, the beamforming angle may be calculated through the previously stored table which associates with a location of the driver seat with a beamforming angle.

As the beamforming angle is set, the beamforming microphone constituting the first and second microphones 510 and 520 may extract a voice signal of which the sound source is set to the location of the driver seat, and output the extracted voice signal.

Then, the signal processing unit 400 may process the voice signals outputted from the first and second microphones, extract a voice signal generated from the direction which coincides with the beamforming angle, and output the extracted voice angle at step S130. Then, the signal processing unit 400 may end the process.

As described above, the signal processing unit 300 may output a voice signal generated from the direction corresponding to the range of the beamforming region around the beamforming angle, and the range of the beamforming region may be set on the basis of the vehicle speed and the intensity of noise contained in each of the voice signals outputted from the first and second microphones 510 and 520.

At this time, when the vehicle speed is high or the intensity of the noise is high, the signal processing unit 400 may set a narrow range of beamforming region. Thus, only a voice signal generated from a narrower beamforming region may be extracted to increase the possibility that the driver's voice is accurately captured.

In accordance with the embodiments of the present invention, the apparatus and method for controlling a beamforming microphone considering the location of a driver seat may control the directivity of the beamforming microphone according to the location of the driver seat such that the beamforming microphone reliably captures the voice of the driver, thereby improving the phone quality of the hands free system for the vehicle.

Although embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. An apparatus for controlling beamforming in a vehicle, the apparatus comprising:

a driver seat sensor configured to detect a position of the driver seat relative to a longitudinal direction of the vehicle;

a controller configured to calculate a beamforming angle of a microphone array based on the position of the driver seat for aligning the beamforming angle with the position of the driver seat and further configured to calculate an angular width around the calculated beamforming angle based on a speed of the vehicle such that the angular width becomes narrower as the speed of the vehicle is higher and such that sound received from within the angular width around the beamforming angle is processed to extract voice signals, wherein the angular width is calculated based on the speed of the vehicle after calculating the beamforming angle based on the position of the driver seat; and a signal processor configured to process voice signals from the microphone array in view of the calculated beamforming angle and the calculated angular width.

2. The apparatus of claim 1, wherein the calculated beamforming angle corresponds to a direction toward the driver seat from the central point between a first microphone and a second microphone of the microphone array.

3. The apparatus of claim 1, further comprising an electronic control unit configured to control overall operations of a hands free system, and transmit the position of the driver seat detected by the driver seat sensor to the controller.

4. The apparatus of claim 1, wherein the controller is configured to calculate the beamforming angle using a previously stored table which associates the position of the driver seat with the beamforming angle.

5. The apparatus of claim 1, wherein the controller is configured to calculate the angular width further based on intensity of noise contained in the voice signals.

6. A method for controlling beamforming in a vehicle, the method comprising:

sensing, by a driver seat sensor, a location of the driver seat relative to a longitudinal direction of the vehicle;

calculating, by a controller, a beamforming angle of a microphone array based on the position of the driver seat for aligning the beamforming angle with the position of the driver seat;

calculating an angular width around the calculated beamforming angle based on a speed of the vehicle such that the angular width becomes narrower as the speed of the vehicle is higher and such that sound received from within the angular width around the beamforming angle is processed to extract voice signals, wherein the angular width is calculated based on the seed of the vehicle after calculating the beamforming angle based on the position of the driver seat; and processing, by a signal processor, voice signals from the microphone array in view of the calculated beamforming angle and the calculated angular width.

7. The method of claim 6, wherein the calculated beamforming angle corresponds to a direction toward the driver seat from the central point between locations a first microphone and a second microphone of the microphone array.

8. The method of claim 6, wherein in the calculating of the beamforming angle, the beamforming angle is calculated through a previously stored table which associates the location of the driver seat with the beamforming angle.

9. The method of claim 6, wherein the angular width is further based on intensity of noise contained in the voice signals.

* * * * *